United States Patent [19]

Robbins

[11] Patent Number: 4,788,523

[45] Date of Patent: Nov. 29, 1988

[54] VIAD CHIP RESISTOR

[75] Inventor: William L. Robbins, Newton, Mass.

[73] Assignee: United States of America, Washington, D.C.

[21] Appl. No.: 130,839

[22] Filed: Dec. 10, 1987

[51] Int. Cl.[4] ..... H01C 1/012

[52] U.S. Cl. ..... 338/309; 338/203; 338/320

[58] Field of Search ..... 338/203, 308, 309, 314, 338/320, 328

[56] References Cited

U.S. PATENT DOCUMENTS 3,648,364 3/1972 Endo ..... 338/312

3,775,725 11/1973 Endo ..... 338/312

3,964,087 6/1976 Mallon ..... 338/320 X 4,486,738 12/1984 Sadlo et al. ..... 338/309 X

*Primary Examiner*—C. L. Albritton

*Attorney, Agent, or Firm*—Robert M. Wohlfarth; John P. Tarlano

[57] ABSTRACT

A viad chip resistor made from an insulative wafer and having a via formed near end of the wafer. Conductive pads surround the vias on both sides of the wafer. A resistive element is formed on one side of the wafer between the vias and is electrically connected to the conductive pads on that side. An array of viad chip resistors, from which said individual viad chip resistors are cut, is also shown.

8 Claims, 3 Drawing Sheets

VIAD CHIP RESISTOR

BACKGROUND OF THE INVENTION

1. Field of the Invention

The present invention relates to an array of viad chip resistors and to individual viad chip resistors.

2. Description of the Prior Art

U.S. Pat. No. 4,486,738 shows an array of castellated chip resistors and a method for fabricating the array. The '738 patent also shows an individual castellated chip resistor and a method for making it.

However, the '738 patent does not show or suggest an array of viad chip resistors. Further, the '738 patent does not show an individual viad chip resistor.

Castellations of a castellated chip resistor are exposed to mechanical injury and electrical contamination when mounted on circuit boards. Castellations also cause mechanical stress, due to heating and cooling of a circuit board, to be easily transmitted from the circuit board to a castellated chip resistor.

A viad chip resistor will have less stress placed on it after it is mounted to a circuit board than does a castellated chip resistor. This is due to the fact that the edges of the ends of a viad chip resistor will not be soldered to the circuit board. Therefore, greater expansion mismatch between the resistor and the substrate of the viad chip resistor can be tolerated under the effects of heating and cooling of the circuit board.

An additional feature of the disclosed viad chip resistor is that it prevents "tombstoning". Tombstoning is a lifting up of one of the ends of a chip resistor, from a circuit board.

In mounting prior art castellated chip resistors to a circuit board, solder wicks up the metal covered ends. Due to uneven heating and cooling of the solder at each end, the solder at a first end pulls the first end downward. This pulling causes a second end to lift off of a circuit board to which it is being attached. This lifting off of the circuit board results in an open circuit to the chip resistor. The open circuit requires a rework of the circuit board. The rework adds to overall manufacturing costs of a complete circuit board.

The disclosed viad chip resistor prevents "tombstoning" since solder will not wet ceramic ends of the disclosed chip resistor. Solder will not wick up the ends of the disclosed viad vaid chip resistor. Therefore, "tombstoning" will not occur. The disclosed viad chip resistor eliminates the rework cost that occurs as a result of "tombstoning".

SUMMARY OF THE INVENTION

The present invention relates to an array of viad film chip resistors and to individual viad chip resistors. Vias are formed within a substrate. They are separated so as to be on either side of each resistor. The vias are filled with a conductive material. First and second conductive pads are placed on a first side of the substrate around the vias.

The pads are electrically connected to the conductive material in the vias. The pads are electrically connected by a resistive material layer on the first side of the substrate. These first and second conductive pads are electrical connected to third and fourth conductive pads placed on a second side of the substrate. These connections are made by means of the conductive material in the vias.

An object of the invention is to provide electrical connectors for a chip resistor that are better protected against mechanical damage.

Another object of the invention is to provide electical connectors for a chip resistor that are better protected against electrical contamination.

A further object of the invention is to provide electrical connectors for a chip resistor that transmit less mechanical stress from a circuit board to the chip resistor.

DESCRIPTION OF THE PREFERRED EMBODIMENTS

Preferred embodiments of the present invention are illustrated by way of examples in FIGS. 1–9.

Figure 1:
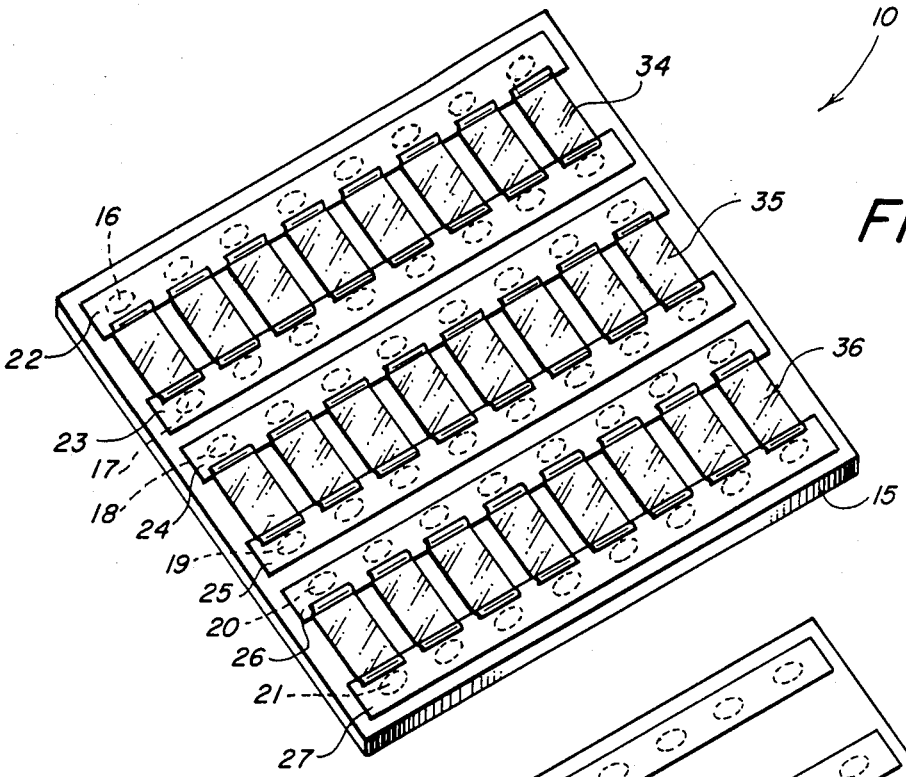
FIG. 1 is a perspective view of the top of a viad chip resistor array having individual conductor strips.

Referring now to the drawings, FIG. 1 shows an array 10. The array 10 may be formed using thick film technology or thin film technology or a mixture thereof. Array 10 comprises substrate 15 of a ceramic or other insulating material. The ceramic material may be a high alumina ceramic such as one containing aluminum nitride, silicon carbide and beryllium oxide.

Substrate 15 is typically a high alumina ceramic material. A commonly processed substrate size is 2 inches by 2 inches by 0.025 inch or 3 inches by 3 inches by 0.025 inches. When alumina substrate is in a green (unfired) state, it is provided with a series of vias 16 through 21 inclusive. The vias are formed by punching or drilling in the conventional manner. The vias could also be formed by masking the substrate areas that are not to be viad and using an appropriate chemical such as a strong acid to etch vias in the substrate.

The viad green ceramic substrate 15 is then fired at a temperature of 1670 c. for 2 hours in a tunnel kiln.

When substrate 15 is initially in the form of a fired ceramic or other insulating material, it may be mechanically drilled or laser bored to provide the pattern of vias therein.

The pattern of via rows 16 to 21 inclusive, in substrate 15, is dependent on the size of the individual discrete viad chip resistors to be formed in array 10. For a discrete resistor 40, shown in FIG. 3, and having dimensions of 50 mils (1.27 mm) in width and 100 mils (2.54 mm) in length, the vias nominally measure 20 mils (0.51 mm) in diameter. The rows of vias 16 and 17 or 18 and 19 or 20 and 21 are spaced 75 mils (1.91 mm) from each other. The rows 17 and 18 or 19 and 20 are spaced 50 mils (1.27 mm) from each other. The rows 16 and 17 or 18 and 19 or 20 and 21 go to form different resistor rows. The resistor rows are spaced 50 mils (1.27 mm) from each other. It will be immediately apparent that the vias may have other forms than the circular shape described. For other component sizes, the vias would be correspondingly spaced. Viad substrate 15 is then placed onto a porous but rigid substrate holder (not shown) of a conventional thick film printer.

The vias in substrate 15 are filled with a conductive paste made of tungsten, a mixture of molybdenum and manganese, silver, gold, or copper. The filling may be performed by placing the substrate in a holder and filling the vias with the conductive paste.

Viad substrate 15 is then placed onto a porous but rigid holder (not shown) of a conventional thick film printer. Conductor stripes 22 to 27 inclusive, such as thick film conductor strips, are then screen printed onto the surfaces of the substrate 15. A conductive ink may be used to form these conductive material regions. The parallel stripes 22 to 27 inclusive extend over the conductive material in parallel rows of vias in substrate 15. The vias are centered within the stripes. The substrate 15 is then removed from the holder and the conductor ink is dried by placing the substrate in an oven.

Alternately, the substrate 15 may be placed in a belt dryer. After drying, the substrate 15 is fired in a kiln capable of sintering the ink stripes and rendering then conductive.

Figure 2:
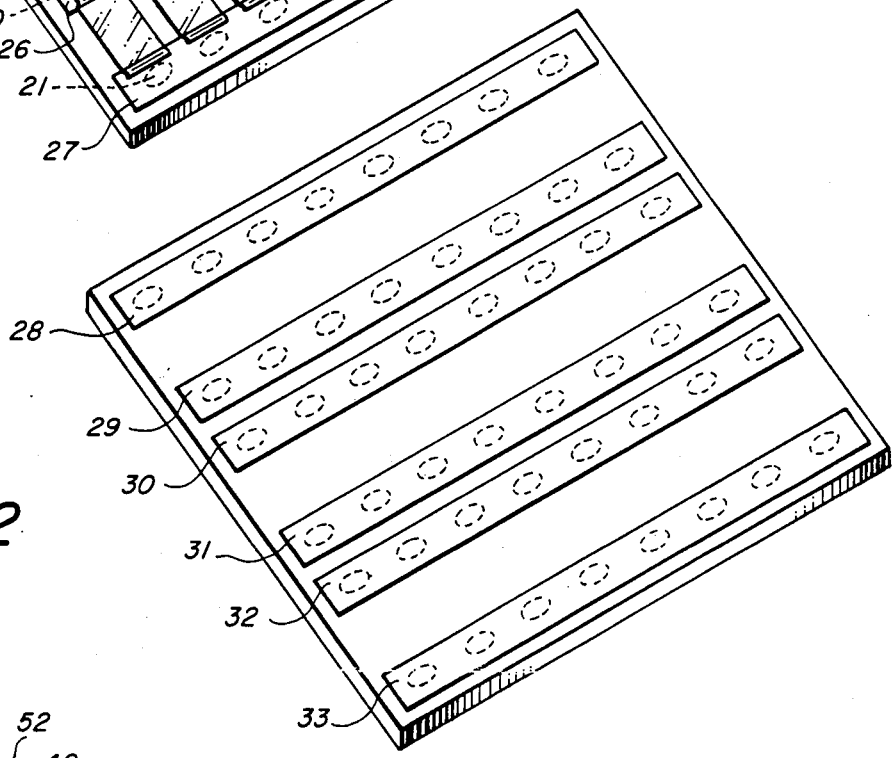
FIG. 2 is a perspective view of the bottom of a viad chip resistor array having individual conductor strips.

As shown in FIG. 2, the conductor forming step is repeated to form parallel strips 28 to 33 inclusive on the opposite side of substrate 15. A conductive ink may be used. The strips 28 through 33 are formed over the conductive material in the vias of vias rows 16 through 21 respectively. The printing step electrically connects adjacent strips on either side of the substrate 15. Electric connection of the adjacent strips is made through the vias. Strips 22 and 28 are thus electrically connected through vias 16, and so forth. The drying and firing steps are then repeated on this opposite surface of the substrate 15. It is apparent that a single firing step may be utilized although in so doing, special kiln furniture may be required.

Once both surfaces of substrate 15 are printed and fired, resistor elements 34, 35 and 36, in the form of transverse bars, are formed. A resistor ink may be used. Thus, the bars 34 extend between and are electrically interconnected to the parallel conductive strips 22 and 23. The resistor ink bars are applied on substrate 15 in the manner and with the equipment described above. The bars 34, 35 and 36 may be made from resistor ink using thick film techniques.

Referring to FIG. 1, it will be seen that the transverse bars 34 are positioned such that each bar 34 is in alignment with and extends between a pair of vias 16 and 17 and slightly overlaps conductive stripes 22 and 23 at each end.

The resistor elements 34, 35 and 36 on substrate 15 are then subjected to the drying and firing steps in the same manner as described above.

The top of the substrate 15, shown in FIG. 1, can then be screen printed with a passivating thick film material. The passivating layer is dried or glazed and fired, usually in the type of equipment utilized for drying and firing described above.

The bottom of the resulting array 10, shown in FIG. 2, can now have the conductor areas or parallel strips 28 to 33 inclusive tinned by one of several conventional means such as screen printing and vapor phase reflow or pneumatic injection of tinning paste onto the conductor areas and reflowing on a conveyer belt heater. The substrate 15 could alternatively be dipped into molten solder to tin the conductive areas.

Figure 3:
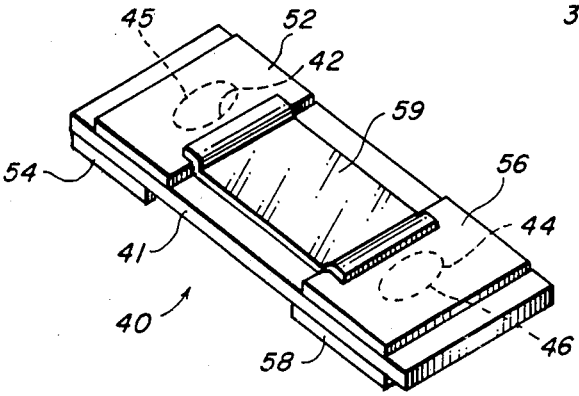
FIG. 3 is a perspective view of a viad chip resistor formed from the array shown in FIGS. 1 and 2.

After this tinning step, the substrate 15 is cut apart such as by scribing with a laser on both sides, in both the x and the y direction. In the x direction, the laser scribing would be along a line parallel to the transverse bars and midway between the bars. In the y direction, the laser scribing would be between conductor ink stripes 23 and 24 or 25 and 26, so as to form individual resistors, such as thick film resistor 40 as shown in FIG. 3. Alternatively, the substrate 15 can be cut apart by using a diamond saw.

An outstanding advantage realized with the arrays of the present invention is that it is possible to provide resistors over a wide range of resistance values with a minimum number of arrays. Thus, depending on the percent of resistor trim allowed, usually 50 to 60%, sixteen to twenty-one different as-fired resistor value arrays can adequately cover a resistor value range from 4 ohms to 8 megohms. Individual resistors in this range of resistance values can be made available with very short lead times since the desired resistor would be produced from the closest as-fired resistor value array by trimming the resistor bar to the desired value by laser cutting or abrading.

Upon separation, the resulting discrete resistor 40, shown in FIG. 3, is seen to comprise an insulating wafer 41 of a ceramic or other insulating material. Said wafer 41 is provided with central conductors 42 and 44 within the interiors of the vias 45 and 46. Conductor 42 electrically connects terminal pads 52 and 54. Conductor 44 electrically connects terminal pads 56 and 58. Resistor layer 59, on the top surface of wafer 41, electrically interconnects terminal pads 52 and 56 and it slightly overlaps these terminal pads.

The resistor 40 may be placed on a printed circuit board. The tinned conductor pads 54 and 58 may be electrically connected to the printed circuit board. Solder on pads 54 and 58 may be reflowed with solder on conductive areas of the printed circuit board that is in contact with the pads 54 and 58.

An example of another technique for making a viad chip resistor array and viad chip resistors of the present invention is given as follows:

EXAMPLE 2

A fired substrate having vias in it is used. The vias are filled with tungsten paste, a mixture of molybdenum and manganese paste or a copper paste. A conductor layer of one of these pastes is formed on the top and bottom of the substrate. Resistor elements are formed of resistive ink. The array is fired. The bottom conductor pads are tinned and the array is cut up. The resistor are solder bonded. Other examples of techniques for making the viad chip resistor array and viad chip resistors of the present invention are as follows:

EXAMPLE 3

A fired substrate having vias in it is used. The vias are filled with tungsten paste, or a mixture of molybdenum and manganese paste or a copper paste. Thick film conductor strips are formed using a conductive ink. After firing, thin film resistor elements are formed by evaporating or sputtering a film of tantalum nitride. The exposed conductor areas on the bottom of the substrate are tinned. The resultant resistor is solder bonded to a circuit board.

EXAMPLE 4

A fired substrate having vias in it is used. The vias are filled with tungsten paste or a mixture of molybdenum and manganese paste or a copper paste. Thick film conductor strips using conductive paste having a base of tungsten, molybdenum, copper, silver alloy, or gold are formed. After firing, thin film resistor elements are formed by evaporating or sputtering on a film of tantalum nitride. The bottom conductor strips are tinned with a tinning agent. The resultant resistor may be solder bonded to a circuit board.

EXAMPLE 5

A fired substrate having vias in it is used. The vias as are filled with tungsten paste, or a mixture of molybdenum and manganese paste or a copper paste. The array is fired. Thin film conductor strips are formed by evaporating or sputtering on a film of chromium, evaporating or sputtering on a film of nickel and then plating a film of nickel on the first nickel film. Thin film resistor elements are formed by evaporating or sputtering a film of tantalum nitride. Solder is screen printed or plated on nickel and hot plate reflowed. Alternatively, the solder can be placed on the bottom nickel conductor strips by solder dipping and hot plate reflowing. The solder could also be placed on the nickel conductor strips by use of vapor phase soldering. The resultant resistor may be solder bonded to a circuit board.

EXAMPLE 6

A fired substrate having vias in it is used. The vias are filled with tungsten paste, or a mixture of molybdenum and manganese paste or a copper paste. The array is fired. Thin film conductor strips are formed by evaporating or sputtering a film made of a mixture of chromium, titanium and gold or a mixture of titanium, platinum and gold or a mixture of chromium and nickel and gold. Thin film resistor elements are formed by evaporating or sputtering a film of tantalum nitride. The resultant resistor may be wire bonded to a circuit board using silver or gold wire.

EXAMPLE 7

A green ceramic substrate is used and vias are formed in it. The vias are filled with tungsten paste, a mixture of molybdenum and manganese paste or a copper paste. A conductor layer of one of these pastes is formed on the top and bottom of the substrate. Resistor elements are formed of conductive ink. The array is fired. The bottom conductor pads are tinned and the array is cut up. The resistors are solder bonded.

Figure 4:
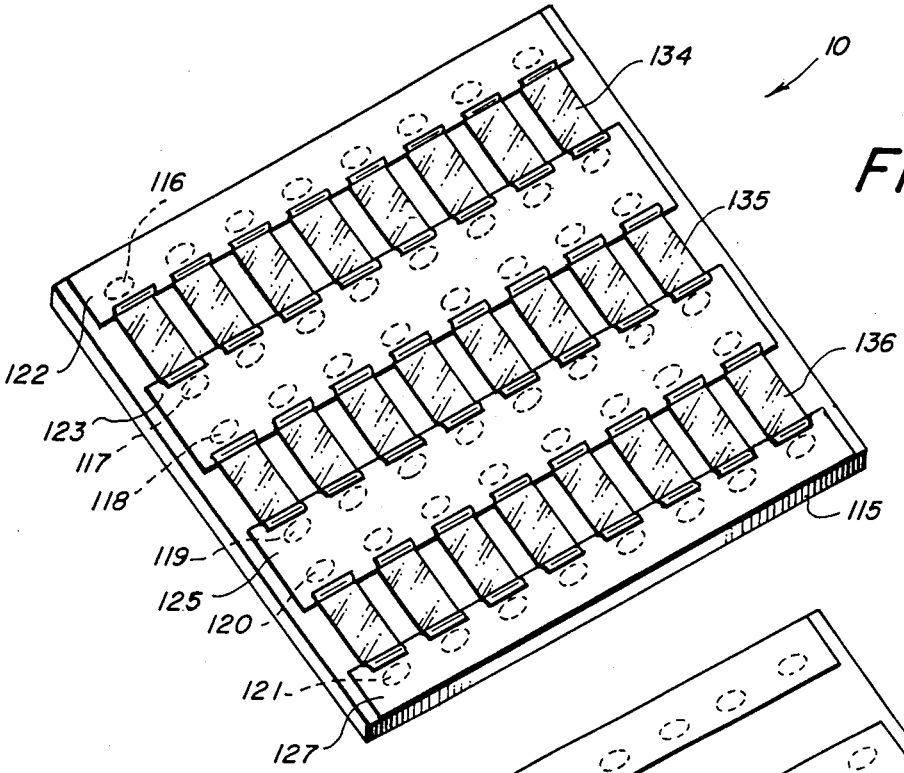
FIG. 4 is a perspective view of the top of a viad chip resistor array having individual and common conductor strips.
Figure 5:
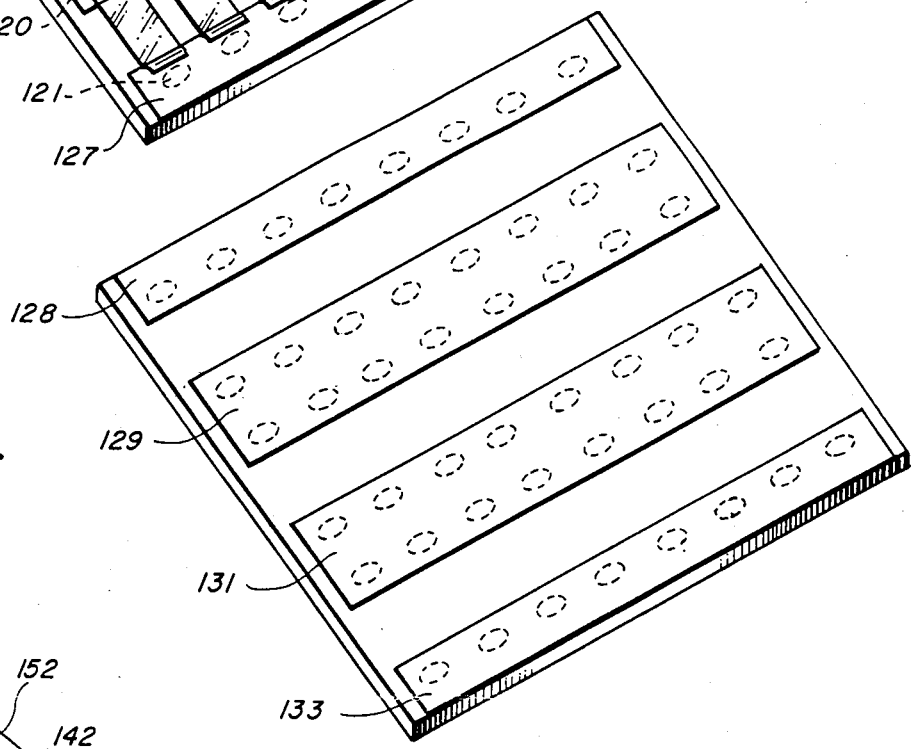
FIG. 5 is a perspective view of the bottom of a viad chip resistor array having individual and common conductor strips.
Figure 6:
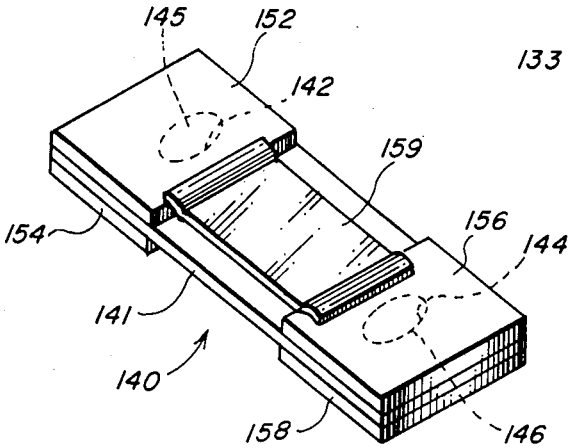
FIG. 6 is a perspective view of a viad chip resistor formed from the array shown in FIGS. 4 and 5.

As shown in FIGS. 4, 5 and 6 the conductors are built so that they will extend to the edges of the ends of the individual completed resistors. In this manner, less contamination might build up near the edges of a resistor as shown in FIG. 6. Further, it is easier to solder the ends of the resistor of FIG. 6 to a circuit bond, since solder does not have to flow under the edges in order to come in contact with the conductor pads.

In FIG. 4, the conductors 122 and 127 extend to the edges of substrate 115. The conductor 123 extends continuously between resistor element rows 134 and 135. Similarly conductor 125 extends continuously between resistor element rows 135 and 136. These conductors make electrical contact with the conductive material in the vias they surround, as shown.

As shown in FIG. 5, conductors 128, 129, 131 and 133 are on the opposite side of substrate 115 from conductors 122, 123, 125 and 127. The conductors on the two sides of substrate 115 correspond in size. These conductors make electrical contact with the conductive material in the vias they surround, as shown.

When the array is cut in a manner described above, a resistor 140 shown in FIG. 6, is formed. The terminal pads 152, 154, 156 and 158 of resistor 140 extend to the edges of the ends of resistor 140. When resistor 140 is placed on a circuit board and the resistor is soldered by placing solder at its ends, the solder does not have to flow under lips at either end to make electrical contact between the circuit board and the resistor 140.

Further, the resistor as shown in FIG. 6 consumes less space on a substrate than does the resistor shown in FIG. 3. Further, more resistors can be formed on a given substrate by the design shown in FIGS. 4, 5 and 6 then by the design shown in FIGS. 1, 2 and 3.

Figure 7:
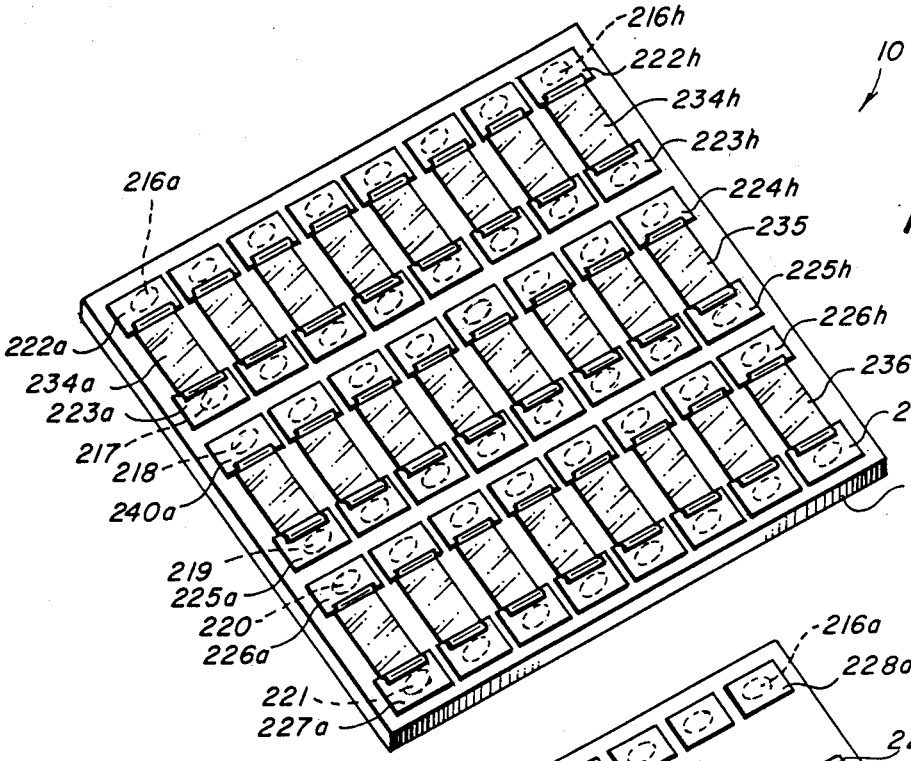
FIG. 7 is a perspective view of the top of a viad chip resistor array having individual conductor pads.

FIG. 7 shows an array of discrete resistors. Conductor pads 222*a* to 222*h*, 223*a* to 223*h*, 224*a* to 224*h*, 225*a* to 225*h*, 226*a* to 226*h* and 227*a* to 227*h* are formed on a substrate 215, by a method such as described above. Resistor rows 234*a* to 234*h* are formed between conductor pads 222*a* to 222*h* and 223*a* to 223*h*, as shown. The conductor pads make electrical contact with conductive material in the vias they surround, as shown.

Figure 8:
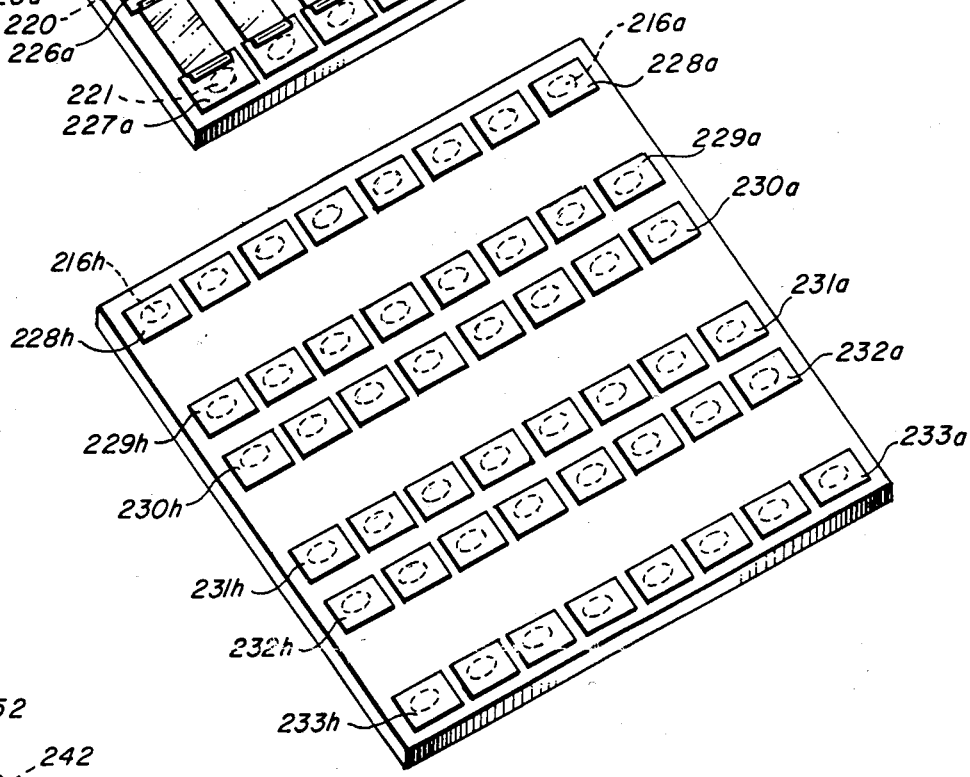
FIG. 8 is a perspective view of the bottom of a viad chip resistor array having individual conductor pads.

FIG. 8 shows conductor pads 228*a* to 228*h*, 229*a* to 229*h*, 230*a* to 230*h*, 231*a* to 231*h*, 232*a* to 232*h* and 233*a* to 233*h*, on the opposite side of substrate 215. Conductor pads 222*a* to 222*h* make electrical contact to conductor pads 228*a* to 228*h* through vias 216*a* to 216*h*. Conductor pads 222*a* to 222*h* and 228*a* to 228*h* are in electrical contact with conductive material in vias 216*a* to 216*h* which they surround. Similarly the other conductor pads shown are electrically connected to the conductor pads on the opposite side of substrate 215 through the corresponding vias.

The array shown in FIG. 7 may be tested, and the resistor values trimmed, tested, and in particular burned in before the array is cut up. The resistance value may be marked on each resistor in the array between the lower conductive pads of each resistor, before cutting up the array. Significant cost savings can be achieved by processing the resistors while they are in the array.

Figure 9:
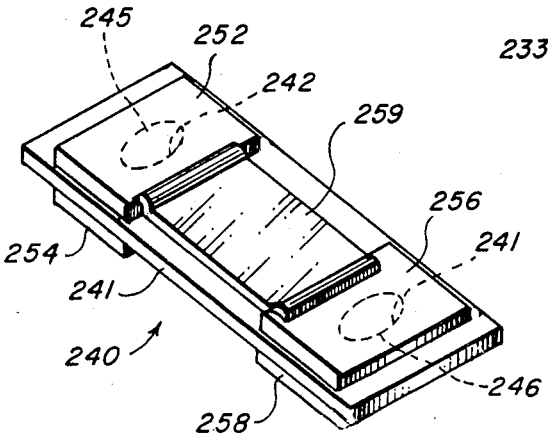
FIG. 9 is a perspective view of a viad chip resistor formed from the array shown in FIGS. 7 and 8.

After burn-in, the individual resistor, such as resistor 240, shown in FIG. 9, may be formed by cutting up the array shown in FIG. 7. A suitable method such as described above may be used for the operation. The resistors are then ready for mounting on a circuit board.

It is noted that instead of one via being used at each end of a chip resistor, two or more vias could be used. In this way, greater probability, i.e. redundancy, of an electrical contact between the upper and lower pads of the resistor will exist.

While the present invention has been disclosed in connection with the preferred embodiment thereof, it should be understood that there may be other embodiments which fall within the spirit and scope of the invention as defined by the following claims.

What is claimed is:

1. An array of spaced electrical circuit components, comprising:

(a) a substrate of electrically insulating material having first and second surfaces;

(b) spaced apart rows of vias in said substrate, the rows having a pattern comprising single rows and double rows, the vias being inward from the edges of the substrate;

(c) conductive material regions, each surrounding at least one via on said first and second surfaces of said substrate;

(d) conductive material within said vias and electrically interconnecting the conductive material regions on the first and second surfaces surrounding those vias; and (e) resistor elements on a surface of said substrate, each resistor element electrically interconnecting two conductive material regions, a conductive material region being associated with a double row of said vias, no via in the substrate being used in conjunction with more than one resistor element.

2. An electrical circuit component, comprising:

(a) a wafer of electrically insulating material having first and second surfaces, of a size for holding a single component;

(b) two vias spaced inward from the edges of the wafer and spaced apart from each other;

(c) terminal pads surrounding said vias, the terminal pads being on the first and second surfaces of said wafer;

(d) conductive material within vias and being electrically interconnected to the terminal pads surrounding those vias; and (e) a resistor element on the uper surface of said wafer and electrically interconnecting said terminal pads.

3. An array of spaced electrical circuit components, comprising:

(a) a substrate of electrically insulating material having first and second surfaces;

(b) spaced apart rows of vias in said substrate, the rows alternately being more distantly spaced and more closely spaced, the rows having a pattern comprising single rows and double rows, the vias being inward of the edges of the substrate;

(c) a conductive material strip surrounding each row of vias, such a strip being on each of said first and second surfaces of said substrate;

(d) conductive material within said vias and electrically interconnecting the conductive material strips on said first and second surfaces surrounding those vias; and (e) resistor elements on a surface of said substrate, the resistor elements electrically interconnecting conductive material strips associated with more distantly spaced rows of vias, no via in the substrate being associated with more than one resistor element.

4. An electrical circuit component, comprising:

(a) a wafer of electrically insulating material having first and second surfaces, of a size for holding a single component;

(b) two vias spaced inward from the edges of the wafer and spaced apart from each other;

(c) terminal pads surrounding at least two vias, the terminal pads being on the first and second surfaces of said wafer, the pads being inward of ends of the wafer and extending to the sides of the wafer;

(d) conductors within at least two vias and being electrically interconnected to the terminal pads surrounding those vias; and (e) a resistor element on a surface of said wafer and electrically interconnecting terminal pads surrounding at least two vias.

5. An array of spaced electrical circuit components, comprising:

(a) a substrate of electrically insulating material having first and second surfaces;

(b) spaced apart rows of vias in said substrate, the rows alternately being more distantly spaced and more closely spaced, the rows having a pattern comprising single rows and double rows, the vias being inward of the edges of the substrate;

(c) a conductive material strip surrounding each of two more distantly spaced rows of vias, such a strip being on each of said first and second surfaces of said substrate, the conductive strip also surrounding a next row of vias, such a strip being on each of said first and second surfaces of said substrate;

(d) conductive material within said vias and electrically interconnecting the conductive material strips on said first and second surfafces surrounding those vias; and (e) resistor elements on a surface of said substrate, the resistor elements electrically interconnecting conductive material strips associated with more distantly spaced rows of vias, no via in the substrate being associated with more than one resistor element.

6. An electrical circuit component, comprising:

(a) a wafer of electrically insulating material having first and second surfces of a size for holding a single component;

(b) two vias spaced inward from the edges of the wafer and spaced apart from each other;

(c) terminal pads surrounding at least two vias, the terminal pads being on the first and second surfaces of said wafer the pads extending to the ends of the wafer and extending to the sides of the wafer;

(d) conductors within at least two vias and being electrically interconnected to the terminal pads surrounding those vias; and (e) a resistor element on a surface of said wafer and electrically interconnecting terminal pads surrounding at least two vias.

7. An array of spaced electrical circuit components, comprising:

(a) a substrate of electrically insulating material having first and second surfaces;

(b) spaced apart rows of vias in said substrate, the rows alternately being more distantly spaced and more closely spaced, the rows having a pattern comprising single rows and double rows, the vias being inward of the edges of the substrate;

(c) a conductive material pad surrounding each via, such a pad being on each of said first and second surfaces of said substrate;

(d) conductive material within said vias and electrically interconnecting the conductive material pads on said first and second surfaces surrounding said vias; and (e) resistor elements on a surface of said substrate, the resistor elements electrically interconnecting conductive material pads associated with more distantly spaced rows of vias, no via in the substrate being associated with more than one resistor element.

8. An electrical circuit component, comprising:

(a) a wafer of electrically insulating material having first and second surfaces of a size for holding a single component;

(b) two vias spaced inward from the edges of the wafer and spaced apart from each other;

(c) terminal pads surrounding said vias, the terminal pads being on the first and second surfaces of said wafer, the pads being inward of the ends of the wafer and inward of the sides of the wafer;

(d) conductors within said vias and being electrically interconnected to the terminal pads surrounding said vias; and (e) a resistor element on a surface of said wafer and electrically interconnecting terminal pads surrounding said vias.

* * * * *